US011326591B2

(12) United States Patent
Dissing

(10) Patent No.: US 11,326,591 B2
(45) Date of Patent: May 10, 2022

(54) PRESSURE BOOSTING DEVICE

(71) Applicant: GRUNDFOS MANAGEMENT A/S, Bjerringbro (DK)

(72) Inventor: Torben Thorsager Dissing, Bjerringbro (DK)

(73) Assignee: GRUNDFOS MANAGEMENT A/S, Bjerringbro (DK)

( * ) Notice: Subject to any disclaimer, the term of this patent is extended or adjusted under 35 U.S.C. 154(b) by 1380 days.

(21) Appl. No.: 15/293,708

(22) Filed: Oct. 14, 2016

(65) Prior Publication Data

US 2017/0107702 A1 Apr. 20, 2017

(30) Foreign Application Priority Data

Oct. 16, 2015 (EP) ..... 15190110

(51) Int. Cl.
*E03B 5/02* (2006.01)
*F04D 27/00* (2006.01)
(Continued)

(52) U.S. Cl.
CPC ..... *F04B 49/02* (2013.01); *E03B 5/02* (2013.01); *F04B 49/06* (2013.01); *F04B 49/065* (2013.01);
(Continued)

(58) Field of Classification Search
CPC ..... F04B 49/02; F04B 49/022; F04B 49/06; F04B 49/065; F04B 49/08; F04B 49/10;
(Continued)

(56) References Cited

U.S. PATENT DOCUMENTS 5,883,489 A * 3/1999 Konrad ..... F04D 15/0066 318/805
6,701,223 B1 * 3/2004 Rachford, Jr. ..... F16K 37/0075 137/45
(Continued)

FOREIGN PATENT DOCUMENTS

CN 101509268 A 8/2009
CN 104074730 A 10/2014
(Continued)

*Primary Examiner* — Dominick L Plakkoottam
*Assistant Examiner* — Charles W Nichols
(74) *Attorney, Agent, or Firm* — McGlew and Tuttle, P.C.

(57) ABSTRACT

A pressure boosting device increases pressure of a fluid flowing through a conduit (5) and includes a booster pump (2), a control device (12), controlling the booster pump (2), as well as a pressure sensor (8) arranged at the exit side of the booster pump (2) and connected to the control device. The control device (12) is configured to control the booster pump, in an operating region, in a start-stop operation, a switching off of the booster pump (2) when reaching an upper pressure limit value ($P_1$) and a switching on of the booster pump (2) when reaching a lower pressure limit value ($P_2$). The control device (12) is further configured in a start-stop operation to automatically adapt at least one pressure control parameter ($P_1$, $P_2$) of the control device (12) on the basis of the temporal course of at least one pressure value (P) detected by the pressure sensor.

18 Claims, 5 Drawing Sheets

(51) Int. Cl.
*F04B 49/02* (2006.01)
*F04B 49/06* (2006.01)

(52) U.S. Cl.
CPC ..... *F04D 27/008* (2013.01); *F04B 2205/04* (2013.01); *F04B 2205/05* (2013.01); *F04B 2205/06* (2013.01)

(58) Field of Classification Search
CPC .. F04B 49/20; F04B 2205/04; F04B 2205/05; F04B 2207/043; F04B 2205/06; F04C 14/06; F04C 14/08; F04C 14/28; F04C 28/08; F04C 2240/81; F04C 2270/05; F04C 2270/051; F04C 2270/185; F04D 15/0033; F04D 15/0066; F04D 15/0077; F04D 15/0083; F04D 15/02; F04D 15/0209; F04D 27/004; F04D 27/008; F04D 27/0261; F04D 27/0292; E03B 5/02
See application file for complete search history.

(56) References Cited

U.S. PATENT DOCUMENTS

| | | | | |
|---|---|---|---|---|
| 7,080,792 | B2 | 7/2006 | Muratsubaki et al. | |
| 2010/0312398 | A1* | 12/2010 | Kidd | F04D 15/0066 700/282 |
| 2014/0052421 | A1* | 2/2014 | Allen | G05B 17/02 703/2 |

FOREIGN PATENT DOCUMENTS

| | | | |
|---|---|---|---|
| DE | 38 24 293 | A1 | 1/1990 |
| EP | 2 778 296 | A1 | 9/2014 |
| JP | 2013 040593 | A | 2/2013 |

* cited by examiner

| b1 | $P_1-P_2$ |
|---|---|
| <0,32 | 0,1bar |
| >=0,32 | 0,5bar |

PRESSURE BOOSTING DEVICE

CROSS REFERENCE TO RELATED APPLICATIONS

This application claims the benefit of priority under 35 U.S.C. § 119 of European Application 15 190 110.5 filed Oct. 16, 2015, the entire contents of which are incorporated herein by reference.

FIELD OF THE INVENTION

The invention relates to a pressure boosting device for increasing the pressure of a fluid flowing through a conduit.

BACKGROUND OF THE INVENTION

Such pressure boosting devices are applied for example in the drinking water supply of buildings, if the conduit-side pressure which prevails in a drinking water supply is not adequately high, in order to deliver the drinking water to the uppermost floors of a building. Such pressure boosting devices comprise one or more booster pumps which can be connected in parallel or in series and which are switched on when the pressure at the exit side of the booster pumps falls short of a predefined limit value. Accordingly, the booster pumps are switched off again after reaching a desired target pressure. Apart from such a start-stop operation, it is particularly with greater flows that it is possible to operate the booster pumps in a constant manner and to control them with regard to their speed, in order to adapt the pressure in the desired manner.

If such a pressure boosting device is operated in the mentioned start-stop operation, then there exist the problem of the time duration between switching the booster pumps on and off, amongst other things being dependent on how large the volume in the connecting conduit system is and in particular in a buffer tank which is present as the case may be. A large volume leads to large pressure fluctuations over a comparatively long time period. An improved comfort with lower pressure fluctuations can be achieved in such a system with the same switch-on duration of the booster pumps. In previous systems, this can only be achieved by manual adaptation.

SUMMARY OF THE INVENTION

With regard to this problem, it is an object of the invention, to improve a pressure boosting device for increasing the pressure of a fluid flowing through a conduit, to the extent that an automatic adaptation to the respective hydraulic system is effected for minimizing the occurring pressure fluctuations. This object is achieved by a pressure boosting device with the features according to the invention.

The pressure boosting device according to the invention serves for increasing the pressure of a fluid flowing through a conduit, for example of drinking water in a drinking water conduit. The pressure boosting device comprises at least one booster pump. However, several booster pumps can also be connected in parallel and/or series. When hereinafter the term booster pump is used, then this expressly also includes such arrangements of several booster pumps. The pressure boosting device moreover comprises a control device which controls the booster pump. For this, at least one pressure sensor arranged at the exit side of the booster pump on or in the conduit is present, and is connected to the control device in a manner such that pressure measurement values which are detected by the pressure sensor are transmitted to the control device.

The control device is configured such that at least in one operating region, it controls the booster pump in a start-stop operation. This means that the pump is switched off on reaching an upper pressure limit value and is switched on when reaching a lower pressure limit value. The pressure in the conduit thus at the exit side of the pressure boosting device is held between the upper and the lower pressure limit value.

According to the invention, the control device is configured in a manner such that it automatically adapts at least one pressure control parameter of the control device in this start-stop operation. Such a pressure control parameter is a parameter which forms the basis of the control of the booster pump by the control device, in particular a parameter which has an influence on the points in time of switching on and switching off in start-stop operation. The automatic adaptation of this at least one pressure control parameter, according to the invention is effected on the basis of the temporal course of at least one pressure value detected by the pressure sensor. A self-learning system is thus created, which automatically adapts to the current conditions in the hydraulic system at the exit side of the pressure boosting device. Preferably the control device is configured in a manner such that the adaptation is effected in a manner such that the pressure difference between the upper and the lower limit value is minimized, without increasing the number of switch-on procedures beyond a predefined limit value. It is therefore ensured that the running time of the booster pump in the start-stop operation is essentially not extended, but at the same time the comfort is however improved by way of pressure fluctuations in the system being minimized. Thus the comfort can be increased with a simultaneous energy efficiency.

According to a preferred embodiment of the invention, the pressure boosting device or its control device is configured in a manner such that the at least one pressure control parameter which is automatically adapted, is the upper and/or the lower pressure limit value. In particular the pressure control parameter can be the difference between the upper and the lower pressure limit value, i.e. can be a hysteresis range. The adaption of the pressure limit value or their difference permits an automatically adaptation of the pressure boosting device to the connecting hydraulic system or to the conditions prevailing in the system, by way of the pressure limit values being adapted such that the pressure difference is minimized in operation, without significantly increasing the number of switch-on procedures or the total switch-on duration of the booster pump. A gain in comfort is therefore achieved. In particular, an adaptation of the system to a tank volume of a buffer tank in the system is possible. It is possible to reduce the pressure difference with larger volumes, so that as a whole reduced pressure fluctuations occur in the system.

According to a further preferred embodiment of the invention, the control device is configured in a manner such that the adaptation of the at least one pressure control parameter, for example of the upper and/or lower pressure limit value, is effected on the basis of the temporal course of at least one detected pressure value in such evaluation time periods, in which a constant flow in the conduit is given. This has the advantage that pressure fluctuations which for example originate from the opening and closure of tapping locations or consumers in the hydraulic system, essentially have no influence on the measurement and adaption of the pressure control parameter. It is thus ensured that indeed essentially only influences which originate from the system itself are taken into consideration. If for example one or more tapping locations of a drinking water conduit are opened, then a sudden pressure drop with a sudden increase of the flow occurs in the system. These condition changes do not originate from the design of the system, but from the consumer behaviour and, wherever possible should be ignored on adaptation. This means that the evaluation should preferably take place in a stable operating condition.

According to a further preferred embodiment of the invention, the control device is configured in a manner such that it puts the evaluation time periods into those time periods, in which the booster pump is switched on with the start-stop operation. This means that the temporal pressure course, on the basis of which the adaptation of the pressure control parameter is effected, is preferably detected during the pressure increase by the booster pump.

According to a further preferred embodiment, the control device is configured such that it puts the mentioned evaluation time periods into time periods, in which a speed of a booster pump is increased or reduced by the control device. This has the advantage that the dependency of the change of the measured pressure in the system on the speed change can be considered. One can assess as to whether the pressure follows the speed change in the expected manner, which is to say the change of the actually detected pressure follows a defined or intended pressure change.

The control device is thus preferably configured to monitor the pressure course, which is to say the course of the pressure which is measured in the system by the at least one pressure sensor, in the evaluation time periods, and only carries out an adaption of the at least one pressure control parameter as long as the pressure course follows a desired pressure course within predefined limits. If this is the case, then one can conclude that no changes of the stable operating condition are present, which for example originate from tapping locations being opened or closed. These influences according to the invention should be ruled out wherever possible.

According to a further preferred embodiment of the invention, the control device is configured in a manner such that it applies a prediction error system identification method for adapting the at least one pressure control parameter. As described above, thereby, the deviation from a predicted pressure valve is taken into account and an adaptation is carried out in a manner such that this deviation or this error is minimized.

The control device preferably comprises a prediction system for the prediction of a pressure value on the basis of a prediction model. Thereby, the prediction system is configured such that the prediction is effected in dependence on the speed of the booster pump. This means that the prediction system predicts an expected pressure value in the system in dependence on a current speed of the booster pump. The prediction system adapts at least one system-parameter in the prediction model on the basis of a defined algorithm, given a detected deviation of the actual detected pressure value from the predicted value. One succeeds in the prediction model being adapted to the actual system and the prediction error being minimized or becoming smaller by way of this.

This system, apart from the adaptation of the control to the actual conditions in the hydraulic system, can also be used in order to recognize changes in the hydraulic system, for example leakages. If greater changes of the at least one system-parameter are necessary in the prediction model after a previously constant operation, then this indicates a change in the system, for example a leakage. The control device can be designed such that it recognizes such a deviation, for example indicates an error.

The prediction system is preferably designed such that it applies a prediction model which is an autoregressive model (ARX model), in particular an autoregressive model (ARX model) of the first order. A prediction of the pressure values can be achieved in a simple manner on the basis of such a model. At least one applied system-parameter can moreover be adapted in the manner described above in such a model, in order to minimize the prediction error.

According to a further preferred embodiment, the control device is configured in a manner such that the at least one pressure control parameter is set in dependence on the at least one system-parameter in the prediction model, in particular on the basis of a predefined algorithm or a table, in particular a predefined table which is stored in the control device. Thus in particular, the pressure limit values which are described above, as pressure control parameters, can be likewise adapted in dependence on the system-parameter in the prediction model, said parameter being adapted in the manner described above. Thus the pressure control parameter which in the start-stop operation preferably has an influence on the switch-on and/or switch-off points in time of the booster pump, is adapted in dependence on the at least one adapted system parameter, so that apart from the minimisation of the prediction error in the previously described manner, the pressure difference between switching on and switching off the booster pump can be minimized and thus a gain in comfort can be achieved.

The control device preferably comprises a pressure controller which closed-loop controls the booster pump to a pressure set point. The pressure regulator is supplied with the pressure command value as an input variable. The pressure set point is preferably set by the control device on the basis of a desired pressure value predefined by a user.

According to a further preferred embodiment, the at least one pressure-control parameter can be a control parameter or control parameter in the pressure regulator. Such a pressure-control parameter can be adjusted alone or in addition to other pressure control parameters in the manner described above on the basis of the temporal course of the pressure value.

Further preferably, the pressure boosting device is configured such that a non-return valve is arranged at the exit side of the booster pump. Such a non-return valve is advantageous, in order, in the case of a switched-off booster pump, to ensure that no backflow of the fluid occurs and the pressure is maintained at the exit side of the booster pump which is to say at the exit side of the non-return valve. Moreover, this non-return valve closes at low flows. In such a condition, a speed change of the booster pump no longer has any influence whatsoever on the actual pressure which is measured by the pressure sensor downstream of the non-return valve. The pressure sensor is preferably arranged downstream of the check valve. When the speed change no longer has an influence on the actual pressure, then the actual pressure no longer follows the predicted pressure value given a reduction of the pressure setpoint which the pump attempts to set by the speed change. A low flow can be recognized from this and the control device can switch the control into the described start-stop operation. The described adaptation of the at least one pressure control parameter is then effected in this condition.

The control device is thus preferably designed such that it controls the booster pump in the described start-stop operation in an operating region, in which a low flow prevails, and it closed-loop controls the booster pump in its speed for reaching a desired pressure increase, in at least one other operating region, preferably an operating region with a large flow. The limit for the start-stop operation can be effected in the manner known from DE 38 24 293 A1. In particular, as described above, this can be recognized by the effect of the non-return valve and by whether the actual pressure course follows the predicted pressure course in desired limits.

With a high flow, the booster pump is preferably in permanent operation and the pressure is set in the desired manner by way of speed regulation or speed adaptation. The booster pump is preferably an electronically regulated pump, in particular a pump regulated via frequency converter, so that the speed can be infinitely changed.

As described beforehand, the control device is preferably configured to recognize the region of low flow. For this, the control device can preferably comprise a flow recognition model which is configured to recognize the operating region of a low flow, on the basis of at least one pressure value detected by the pressure sensor and on the basis of speed changes of the booster pump. The pressure sensor thereby is arranged downstream of a non-return valve as is described above. The flow recognition model can recognize the region of low flow by way of the fact the measured pressure value no longer follows a pressure set point change, give a closed non-return valve, which occurs at a low flow. This means that the limit for the region of a low speed, in which one switches onto the start-stop operation, depends on the function of the non-return valve and preferably its biasing.

The invention is hereinafter described in more detail by way of the attached figures. The various features of novelty which characterize the invention are pointed out with particularity in the claims annexed to and forming a part of this disclosure. For a better understanding of the invention, its operating advantages and specific objects attained by its uses, reference is made to the accompanying drawings and descriptive matter in which preferred embodiments of the invention are illustrated.

DESCRIPTION OF THE PREFERRED EMBODIMENTS

Figure 1:
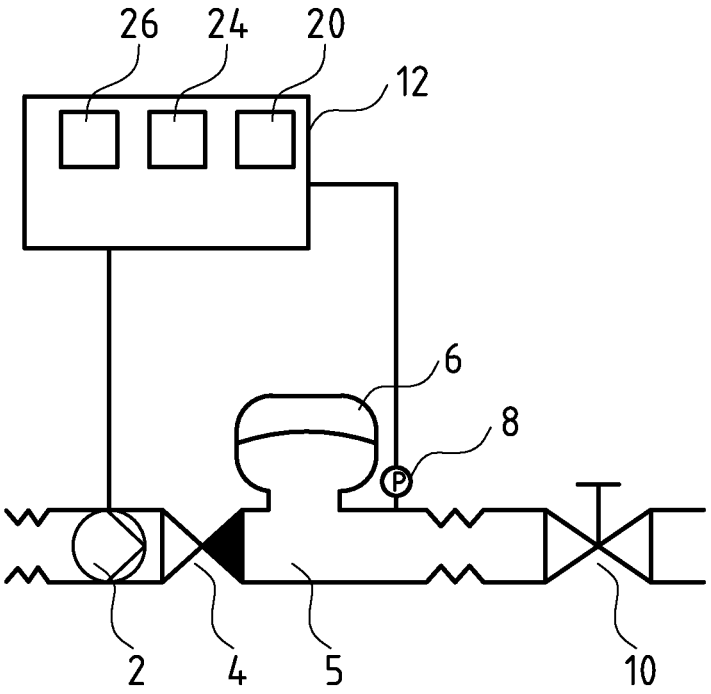
FIG. 1 is a schematic view of a pressure boosting device according to the invention.

Referring to the drawings, FIG. 1 schematically shows a pressure boosting device in a drinking water supply conduit. The pressure boosting device comprises a booster pump 2, to which a non-return valve 4 connects further downstream at the exit side. A buffer tank 6 is arranged at the exit side of the non-return valve 4 and in the usual manner can be designed as a storage tank with a membrane and a closed air volume which is arranged thereabove. A pressure sensor 8 which detect the pressure P at the exit side of the booster pump 2 and at the exit side of the non-return valve 4 is arranged further downstream. A valve 10 is represented schematically further downstream and is to represent one or more consumers, for example tapping locations and via which the flow in the conduit 5 is set at the exit side of the non-return valve 4. It is to be understood that in practice, a branched network/mains with a multitude of valves 10 can connect to the conduit 5 instead of one valve 10.

A control device 12 is moreover present, and this controls or regulates (closed-loop controls) the booster pump 2. The booster pump 2 for this, on the one hand is switched on and off, and on the other hand is also regulated in its speed, by the control device 12. For this, the booster pump 2 can be activated via a speed controller, in particular a frequency converter. The control device 12 is signal-connected to the pressure sensor 8, so that it receives pressure values detected by the pressure sensor 8.

It is to be understood that also several booster pumps connected in parallel and/or series can be applied instead of an individual booster pump 2, and these are controlled or regulated by the control device 12. Wherever a booster pump 2 is described here, it is to be understood that this expressly also includes an arrangement of several booster pumps 2.

There are preferably two operating conditions on operation of the shown pressure boosting device, specifically, an operating condition of a low flow and an operating condition of high flow. The booster pump 2 in the operating condition of a high flow preferably runs in permanent operation and is regulated in its speed via the control device 12 in dependence on the pressure value detected at the pressure sensor 8, in order to achieve or maintain a desired pressure value.

In the operating condition of a low flow, the non-return valve 4 closes and the speed regulation of the booster pump 2 no longer has any influence on a pressure decrease in the conduit 5. Inasmuch as this is concerned, a pressure regulation as has been described beforehand can no longer be carried out. In this operating condition, the pressure boosting device switches into a start-stop operation, with which the booster pump 2 is switched-on when the pressure P in the conduit 5 drops below a lower pressure limit value, and the booster pump 2 is switched off when the pressure P in the conduit 5 reaches an upper pressure limit value. This switching of the booster pump 2 on and off is accomplished by the control device 12.

Figure 2A:
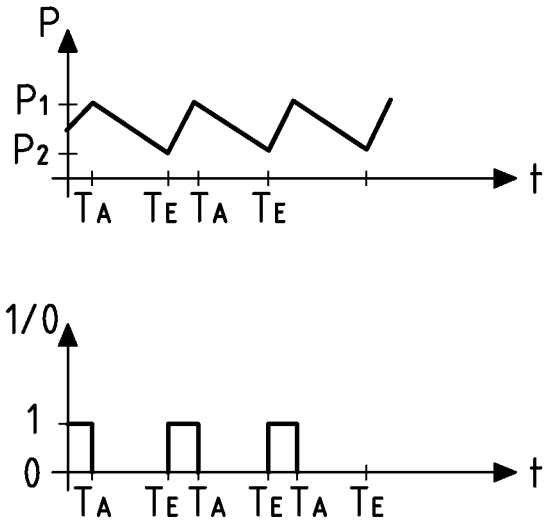
FIG. 2*a* is a view showing a pressure course in start-stop operation of a pressure boosting device, with a low flow.
Figure 2B:
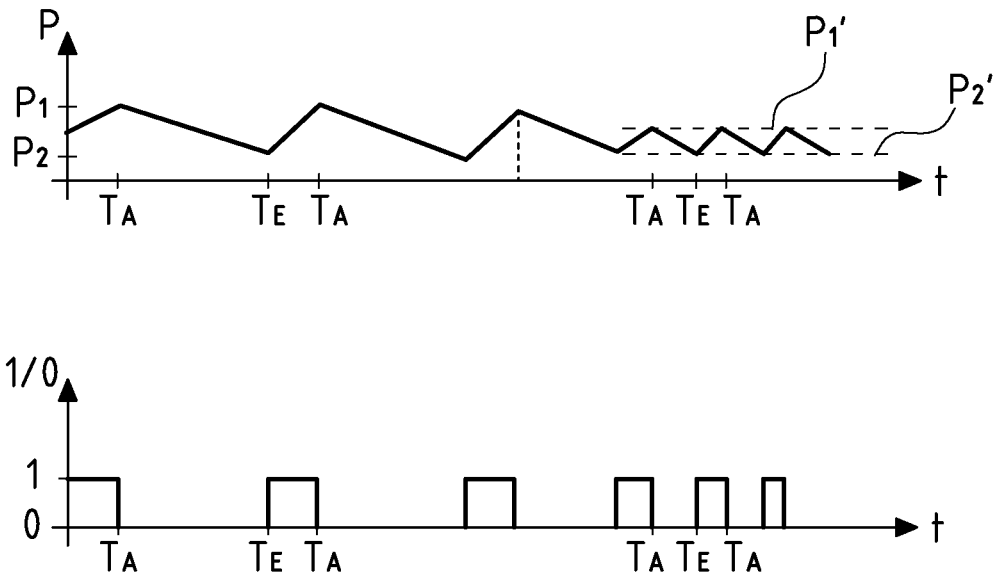
FIG. 2*b* is a view showing a pressure course in start-stop operation of a pressure boosting device, with a low flow.
Figure 7:
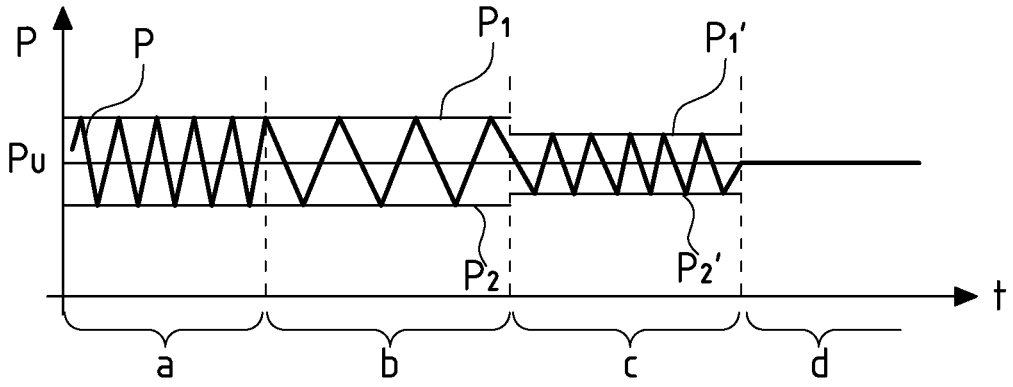
FIG. 7 is a pressure curve over time for four different operating states.

The size of the buffer tank 6 is of great significance in this start-stop operation, since the occurring pressure fluctuations are dependent on this, as is explained by way of FIG. 2*a* and FIG. 2*b*. The pressure P in the conduit 5 is plotted over time tin each the upper diagram in FIG. 2*a* and FIG. 2*b*. The lower diagram shows the switch-on conditions of the booster pump 2 in each case over time t. The booster pump 2 is switched on at the value 1 and is switched off at the value 0. FIG. 2*a* shows in the upper curve the pressure course over time t with a small tank volume and in the lower curve the associated switch-on states. The booster pump 2 is switched off in each case on reaching the upper pressure limit value $P_1$ at the switch-off points in time $T_A$. The pressure subsequently drops to the lower pressure limit value $P_2$. The booster pump 2 is switched on again when this is reached at the switch-on point in time $T_E$, until the upper pressure limit value $P_1$ is reached again at the point in time $T_A$. The upper diagram in FIG. 2*b* shows the pressure course with a larger volume of the buffer tank 6. With a comparison of the upper diagram in FIG. 2*a* and FIG. 2*b*, it can be recognized that the interval between the switch-off point in time $T_A$ and the switch-on point in time $T_E$ becomes larger when a greater volume of the buffer tank 6 is present. The pressure P in the conduit 5 then reduces more slowly. According to the invention, one now envisages changing or adapting the pressure limit values $P_1$ and $P_2$ in this condition. The upper pressure limit value $P_1$ is reduced to the pressure limit value $P_1'$, and the lower pressure limit value $P_2$ is increased to the lower pressure limit value $P_2'$ this means the hysteresis range is reduced to $P_1'$-$P_2'$ The pressure difference between switching the booster pump 2 on and off is thus reduced. The temporal interval between the switch-off points in time $T_A$ and the switch-on points in time $T_E$ simultaneously also shortens again. Thus, given an essentially equal running time and switch-on frequency of the booster pump 2, a smoother pressure course with lower pressure fluctuations is achieved with a large volume of the buffer tank 6, as with a small volume of the buffer tank 6. The effect of this adjustment will be clear from FIG. 7, which shows the pressure profile P over the time t, similar to the upper curve in FIG. 2*b*. In a first operating state a lower through-flow prevails in a small tank volume. The actual pressure P fluctuates around the user selected pressure $P_U$ in a relatively large bandwidth. The switching intervals are short. The operating condition b in FIG. 7 represents a state low flow at a greater tank volume. The pressure fluctuations remain the same, however lengthen the intervals between switching on and off of pressure booster pump 2. The operating range c represents a low flow with a large tank volume after adjustment of the pressure limits $P_1$ and $P_2$. The switching intervals are shortened again. Simultaneously, the pressure fluctuations around the desired value $P_U$ are reduced. The operating range d corresponds to an operating region of high flow, in which the booster pump 2 will no longer operate in start-stop operation but in constant operation with pressure control. In this operating range there are no pressure variations substantially.

Figure 3:
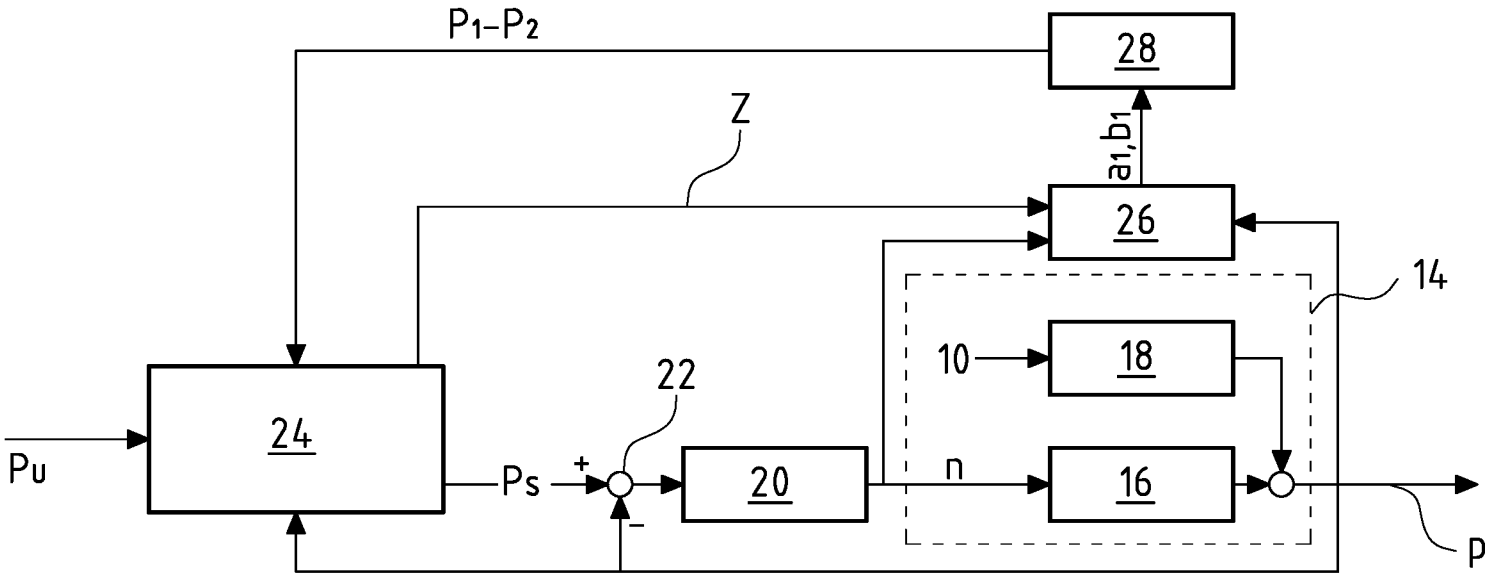
FIG. 3 is a schematic view of the closed-loop control of a pressure boosting device according to the invention.

The adaptation and regulation is now described in more detail by way of FIG. 3. FIG. 3 in a diagram shows the course of the regulation or control of the booster pump 2 by the control device 12. The regulation components shown in FIG. 3 are integrated into the control device 12 or run there in suitable modules. Thereby, it is particularly the case of software modules. The physical system 14 and its influences on the control or regulation are characterized in FIG. 3 by the dashed line. A significant constituent of the physical system 14 is a transfer function 16 which represents the hydraulic system or is formed by the hydraulic system and on which the conversion of the speed n of the booster pump 2 into the pressure P in the conduit 5 depends. Moreover, there is yet a user-dependent transfer function 18 which represents the influence of the position of the valve 10. The pressure P in the conduit 5 likewise changes depending on the position of the valve 10. This is represented by the transfer function 18. The speed n is the output variable of a pressure controller 20 which is integrated in the control device 12. A desired pressure $P_S$, from which the actual pressure P is subtracted at the subtractor 22, is led to the pressure controller 20.

The desired pressure $P_S$ is computed or outputted by a state control or state control module 24. The state control module 24 is supplied with a desired user pressure $P_U$ as an input variable. The difference between the upper pressure limit $P_1$ and the lower limit pressure $P_2$, i.e. a hysteresis range $P_1$-$P_2$, are determined in a parameter module 28. This is done on basis of the parameters $a_1$ and $b_1$ determined in a prediction module 26. A prediction model which in the present example is an autoregressive model of the first order (ARX model) is applied in the prediction module 26. Its parameters $a_1$ and $b_1$ are determined in a prediction module 26. The actual pressure P, the speed n as well as a condition value Z are led to the prediction module 26 as input variables, wherein the condition value Z represents the operating region, specifically an operating region of low flow or an operating region of high flow, wherein the start-stop operation is applied in the operating region of low flow. An adaptation of the regulation or control to the condition of the physical system 14 is effected on basis of at least one of the parameters $a_1$ and $b_1$ within the framework of a prediction error system identification method in the way that in the parameter module 28 the pressure control parameters in form of the pressure limits $P_1$ and $P_2$ are adjusted. The difference of the pressure limits $P_1$ and $P_2$ is an example for a pressure control parameter which has to be adjusted. However, even other pressure control parameters can be adjusted in a corresponding manner, for example parameters which influence the pressure control. The actual pressure limits $P_1$ and $P_2$ are determined on basis of the desired pressure $P_U$ by the state control module 24, so that the desired pressure $P_U$ is preferably situated in the middle of the hysteresis range $P_1$-$P_2$.

Figure 4:
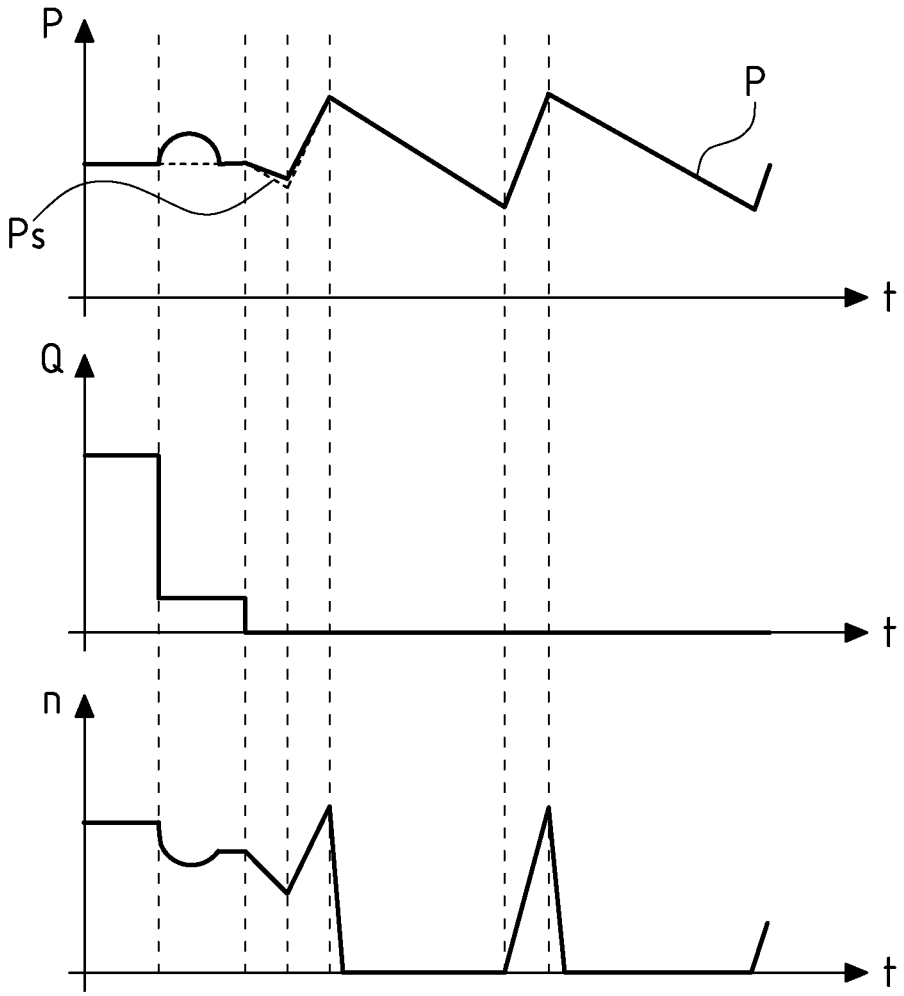
FIG. 4 is a schematic view of the start-stop operation at low flows.

The control device 12 and in particular its condition module 24 in particular have an operating condition recognition function, in order to determine the region of low flow, in which a start-stop operation is to take place. As to how this functions, is explained by way of FIG. 4. In FIG. 1, the lower curve shows the speed n of the booster pump 2 over time t. The upper curve shows the pressure course of the pressure P over time t, wherein the unbroken line represents the actually measured pressure P at the pressure sensor 8, and the dashed line represents the desired pressure $P_S$. The middle diagram in FIG. 4 represents the flow Q over time t. Thereby, the three shown diagrams represent course which is parallel with regard to time. The flow Q drops at the point in time t1, so that the operating condition changes from a condition of large flow into the condition of a low flow or substantially without flow. As is to be recognized by the unbroken line in the upper diagram, the actual pressure P firstly increases at this point in time, and drops again to the desired pressure $P_S$ due to the pressure regulation carried out in the pressure controller 20. The recognition as to whether a condition of a lower flow is given is effected between the points in time t2 and t3. For this, the desired pressure $P_S$ and thus the speed n is reduced, and it is examined as to whether the actual pressure course P follows the course of the desired pressure $P_S$. This is recognizably not the case in FIG. 4. The system thereupon switches into the start-stop operation. The booster pump 2 is switched-on between the points in time t3 and t4 as well as t5 and t6 in this example. The speed n and thus the pressure P increase. The booster pump 2 is switched off between the points in time t4 and t5 and near the point in time t6. The speed firstly drops at the beginning of the switch-off time period. The pressure P then drops more slowly, as has been explained by way of FIG. 2.

An ARX model of the first order in the subsequent form is applied in the prediction model which is applied in the prediction module 24:

$$P[k]=-a_1P[k-1]+b_{n1}[k-1].$$

In this equation, P is the pressure, k is the sample or cycle number, n the speed and $a_1$ and $b_1$ represent two parameters.

The parameters $a_1$ and $b_1$ can be determined via an algorithm, for example in the subsequently represented manner:

$$a_1[k]=a_1[k-1]-\lambda e[k]P[k-1]$$

$$b_1[k]=b_1[k-1]+\lambda e[k]n[k-1]$$

Figures 5, 6:
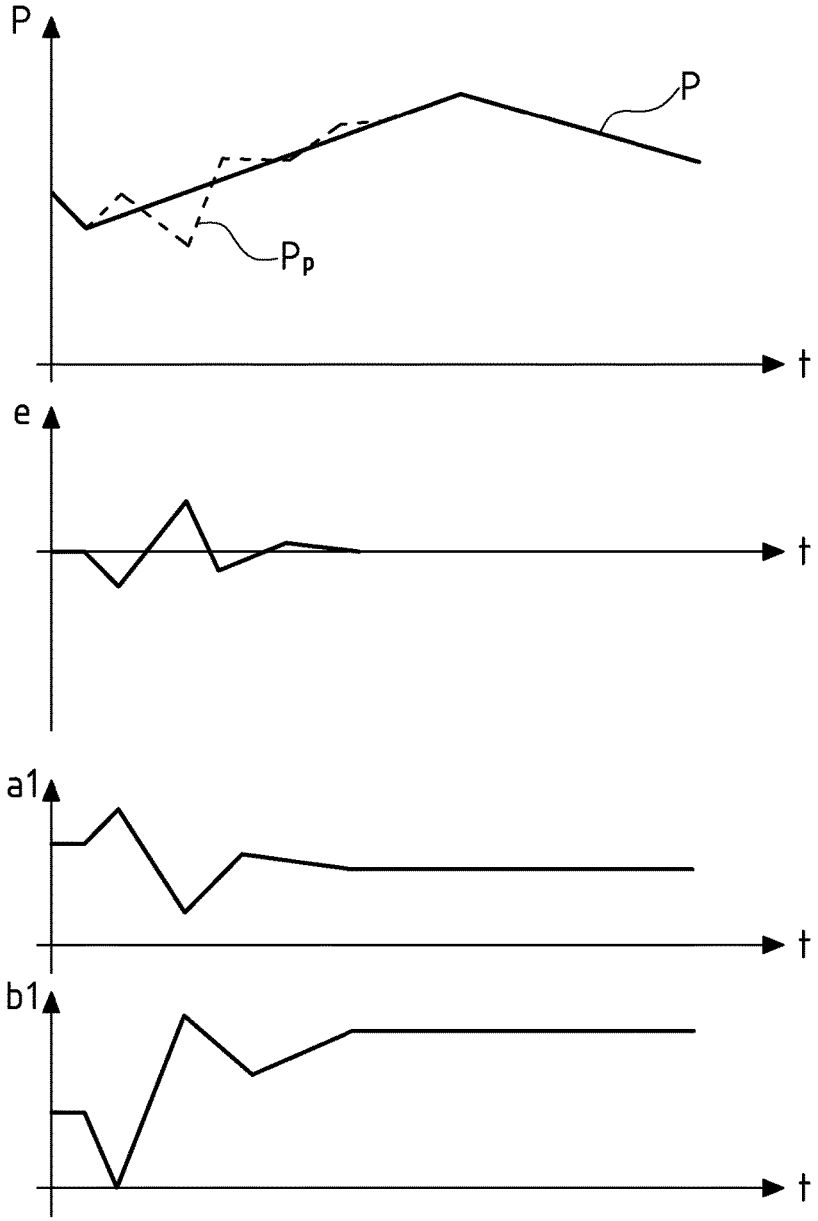
FIG. 5 is a schematic view of the parameter adaption in a pressure boosting device according to the invention.
FIG. 6 is a table for determining the pressure difference between pressure limit values.

Thereby λ, represents a step variable parameter and e the prediction error. The manner of functioning of the prediction model for adapting the predicted pressure $P_p$ is explained by way of FIG. 5. FIG. 5 in the upper diagram shows the pressure plotted against time t, wherein the unbroken line shows the measured pressure P and the dashed line shows the predicted pressure Pp. The second diagram shows the prediction error e with respect to time t and the two lower curves represent the parameters $a_1$ and $b_1$ with respect to time t. It is to be recognized that the predicted pressure $P_p$ initially differs greatly from the actual pressure P. A prediction error e results from this, on the basis of which the parameters $a_1$ and $b_1$ are adapted such that the predicted pressure $P_p$ and the actual pressure P are brought to coincide which is to say that the prediction error e essentially becomes zero.

According to the invention, these prediction error method are also utilized to adapt at least one pressure control parameter in the parameter module 28. In this example, the pressure control parameter is the difference $P_1-P_2$ of the pressure limit values $P_1$ and $P_2$. The adaption of these pressure limit values in this embodiment example is effected on the basis of the parameter $b_1$. A table is stored in the control device 12, in particular in the parameter module 28, and this table defines the pressure differences between the pressure limit values $P_1$ and $P_2$, for certain parameters $b_1$, i.e. pressure hysteresis ranges. Pressure limit values $P_1$ and $P_2$ can also alternatively be stored directly in the table, for this it is additionally necessary to feed the desired pressure $P_U$ to the parameter module 28, and to consider this desired pressure $P_U$ in the table. Such a table from which the pressure differences $P_1-P_2$ results, looks like that which is represented in FIG. 6 for example. There, a pressure difference or hysteresis of 0.1 bar between the pressure limit values $P_1$ and $P_2$ is envisaged for example for a value of the parameter $b_1<0.32$, wherein a pressure difference range of 0.5 bar is envisaged for the case in which the parameter $b_1$ is larger or equal to 0.32. It is conceivable for the table to be designed in a more detailed manner in yet more pressure steps, in order to permit a finer adaptation.

The described adaption of the parameters $a_1$ and $a_2$ is preferably effected at operating points or in operating regions of the booster pump 2, in which a stable operating condition, which is to say in particular an as constant as possible flow is given. This is the case for example between the points in time t3 and t4 as well as t5 and t6, in the diagram according to FIG. 4. A constant flow prevails in this point in time, which is to say the position of the valve 10 is not changed. The control device 12 is preferably designed such that it recognizes these operating conditions. In particular, it recognizes a change of the flow by way of the fact that the pressure suddenly changes or the actually measured pressure P deviates from the desired pressure $P_S$, in the mentioned operating regions. If such a condition is recognized, then the adaptation of the parameters $a_1$ and $b_1$ is skipped, until a stable operating condition is reached again. Thus, the control device 12 can be designed such that for example a parameter adaptation of the parameters $a_1$ and $b_1$ is always carried out when the booster pump 2 is switched on in start-stop operation, as long as no changes of the pressure course due to a change in the position of the valve are detected. The table, according to which the difference $P_1-P_2$ of the pressure limit values $P_1$ and $P_2$ are adapted, is defined such that the pressure difference or hysteresis range $P_1-P_2$ are determined in dependence on the parameter $b_1$, such that the pressure difference is minimized, without the number of switch-on procedures of the booster pump 2 exceeding a certain limit. This is ensured by the predefined table. The difference $P_1-P_2$ of the pressure limit values $P_1$ and $P_2$ which represent the pressure control parameters are also adapted on the basis of the course of the measured pressure P, since the parameter $b_1$ is dependent on the course of the measured pressure P.

While specific embodiments of the invention have been shown and described in detail to illustrate the application of the principles of the invention, it will be understood that the invention may be embodied otherwise without departing from such principles.

APPENDIX

List of Reference Symbols

2 booster pump
4 non-return valve
5 conduit
6 buffer tank
8 pressure sensor
10 valve
12 control device
14 physical system
16 transfer function
18 user-dependent transfer function
20 pressure controller
22 subtractor
24 state control module,
25 prediction module, prediction system
28 parameter module
P pressure
$P_U$ desire pressure
$P_p$ predicted pressure
$P_S$ desired pressure
$P_1$, $P_1'$ upper pressure limit value
$P_2$, $P_2'$ lower pressure limit value
t time
$T_A$ switch-off point in time
$T_E$ switch-on point in time
$a_1$, $b_1$ parameters
Z condition variable
Q flow

What is claimed is:

1. A pressure boosting device for increasing the pressure of a fluid flowing through a conduit, the device comprising:

at least one booster pump;

a control device configured to control the booster pump; and at least one pressure sensor arranged at an exit side of the booster pump, the at least one pressure sensor being connected to the control device, wherein the control device is configured to, in one operating region, control the booster pump in a start-stop operation including switching off the booster pump upon reaching an upper pressure limit value and switching on the booster pump upon reaching a lower pressure limit value, and the control device is configured to, in the start-stop operation, automatically adapt the upper pressure limit value or the lower pressure limit value or both the upper pressure limit value and the lower pressure limit value or a pressure difference between the upper and lower pressure limit value, and wherein the control device is configured to effect the adaptation of the upper pressure limit value or the lower pressure limit value or both the upper pressure limit value and the lower pressure limit value or the pressure difference between the upper and lower pressure limit value based on a temporal course of at least one detected pressure value in evaluation time periods, in which a constant flow prevails in the conduit, based on pressure input provided by the pressure sensor.

2. A pressure boosting device according to claim 1, wherein the control device is configured to set the evaluation time periods as the time periods in which the booster pump is switched-on with the start-stop operation.

3. A pressure boosting device according to claim 1, wherein the control device is configured to set the evaluation time periods the periods in which a speed of the booster pump is increased or reduced by the control device.

4. A pressure boosting device according to claim 1, wherein the control device is configured to monitor the pressure course in the evaluation time periods and only carries out an adaptation of the upper pressure limit value or the lower pressure limit value or both the upper pressure limit value and the lower pressure limit value or the pressure difference between the upper and lower pressure limit value with the pressure course following a desired pressure course within predefined limits.

5. A pressure boosting device according to claim 1, wherein the control device is configured to apply a prediction error system identification method for adapting the upper pressure limit value or the lower pressure limit value or both the upper pressure limit value and the lower pressure limit value or a pressure difference between the upper and lower pressure limit value.

6. A pressure boosting device according to claim 1, wherein the control device comprises a prediction system for predicting a pressure value based on a prediction model in dependence on a speed of the booster pump and in a case of a deviation of the actually detected pressure value from the predicted pressure value, the prediction system adapts at least one parameter in the prediction model on the basis of a predefined algorithm.

7. A pressure boosting device according to claim 6, wherein the prediction model is an autoregressive model.

8. A pressure boosting device according to claim 7, wherein the prediction model is a first order autoregressive model.

9. A pressure boosting device according to claim 6, wherein the control device is configured to set at least one pressure control parameter in dependence on the at least one parameter in the prediction model.

10. A pressure boosting device according to claim 9, wherein the control device is configured to set at least one pressure control parameter on the basis of a predefined algorithm or a table.

11. A pressure boosting device according to claim 6, wherein the control device comprises a pressure controller which regulates the booster pump to a pressure setpoint.

12. A pressure boosting device according to claim 11, wherein the upper pressure limit value or the lower pressure limit value or both the upper pressure limit value and the lower pressure limit value or a pressure difference between the upper and lower pressure limit value is a control parameter in the pressure controller.

13. A pressure boosting device according to claim 1, further comprising a non-return valve arranged at the exit side of the booster pump.

14. A pressure boosting device according to claim 1, wherein the control device is configured in an operational region, in which a low flow prevails, to control the booster pump in the start-stop operation; and at least one other operating region to control the booster pump with a closed-loop control, to a speed for achieving a desired pressure increase.

15. A pressure boosting device according to claim 1, wherein the control device comprises a flow recognition module configured to recognize the operating region of a low flow on the basis of at least one pressure value detected by the pressure sensor and based on changes of a desired pressure of the booster pump.

16. A pressure boosting device for increasing the pressure of a fluid flowing through a conduit, the device comprising:

at least one booster pump;

a control device configured to control the booster pump; and at least one pressure sensor arranged at an exit side of the booster pump, the at least one pressure sensor being connected to the control device, wherein the control device is configured to, in one operating region, control the booster pump in a start-stop operation including switching off the booster pump upon reaching an upper pressure limit value and switching on the booster pump upon reaching a lower pressure limit value, and the control device is configured to, in the start-stop operation, automatically change at least one of the upper pressure limit value, the lower pressure limit value and a pressure difference between the upper and lower pressure limit value of the control device based on pressure input from the pressure sensor, and wherein the control device is configured to effect changing of the at least one of the upper pressure limit value, the lower pressure limit value and the pressure difference between the upper and lower pressure limit value based on a temporal course of at least one detected pressure value in evaluation time periods, in which a constant flow prevails in the conduit.

17. A pressure boosting device according to claim 16, wherein the control device is configured to apply a prediction error system identification method for changing the at least one of the upper pressure limit value, the lower pressure limit value and the pressure difference between the upper and lower pressure limit value.

18. A pressure boosting device according to claim 16, wherein the control device comprises a prediction system for predicting a pressure value based on a prediction model in dependence on a speed of the booster pump and in a case of a deviation of the actually detected pressure value from the predicted pressure value, the prediction system adapts at least one parameter in the prediction model on the basis of a predefined algorithm.

* * * * *